US007165760B2

(12) United States Patent
Campbell

(10) Patent No.: US 7,165,760 B2
(45) Date of Patent: Jan. 23, 2007

(54) RETAINING-LOCKING SYSTEM FOR CHAIN LINK FENCE SLATS

(76) Inventor: Paul Campbell, 31554 Clay River Rd., Barstow, CA (US) 92311

( * ) Notice: Subject to any disclaimer, the term of this patent is extended or adjusted under 35 U.S.C. 154(b) by 38 days.

(21) Appl. No.: 10/740,697

(22) Filed: Dec. 18, 2003

(65) Prior Publication Data

US 2005/0133775 A1 Jun. 23, 2005

(51) Int. Cl.
*E04H 17/02* (2006.01)

(52) U.S. Cl. ..... 256/34; 256/32; 256/33

(58) Field of Classification Search ..... 256/1, 256/32, 33, 34

See application file for complete search history.

(56) References Cited

U.S. PATENT DOCUMENTS

| | | | |
|---|---|---|---|
| 4,570,906 | A | 2/1986 | Walden |
| 4,723,761 | A | 2/1988 | Cluff |
| 4,725,044 | A | 2/1988 | Cluff |
| 4,836,505 | A | 6/1989 | Meglino |
| 4,860,997 | A | 8/1989 | Schoenheit et al. |
| 4,950,098 | A | 8/1990 | Abbott et al. |
| 4,995,591 | A | 2/1991 | Humphrey et al. |
| 5,007,619 | A | 4/1991 | Sibeni |
| 5,106,058 | A | 4/1992 | Finkelstein |
| 5,165,664 | A | 11/1992 | Cluff |
| 5,184,801 | A | 2/1993 | Finkelstein |
| 5,234,199 | A | 8/1993 | Cluff |
| 5,275,380 | A | 1/1994 | Barsby |
| 5,465,941 | A | 11/1995 | Abbott |
| 5,584,468 | A | 12/1996 | Meglino et al. |
| 5,687,957 | A | 11/1997 | Finkelstein |

*Primary Examiner*—Daniel P. Stodola
*Assistant Examiner*—Michael P. Ferguson
(74) *Attorney, Agent, or Firm*—David A. Belasco; Belasco Jacobs & Townsley, LLP

(57) ABSTRACT

A retaining-locking system for chain link fence slats includes specially notched fence slat elements having a pointed upper or lower end. The slat elements are sized and shaped to be interwoven between consecutive links of a chain link fence. A retaining-locking strip is formed of resilient material, and has an inner surface and an outer surface and at least one securing protrusion. The securing protrusion is sized and shaped to fit slidably within the notch. The protrusion is located on the outer surface of the strip. When the slat elements are interwoven into between consecutive links of a chain link fence with each of the notches aligned with one another, the retaining-locking strip inserted between the slat elements and the links, with the securing protrusion disposed within the slats, the strip will urge the slats toward the links, thereby retaining the slats within the chain link fence.

14 Claims, 5 Drawing Sheets

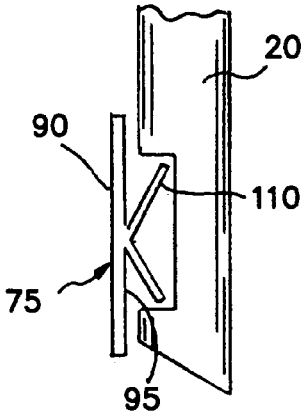
FIG. 14
FIG. 15
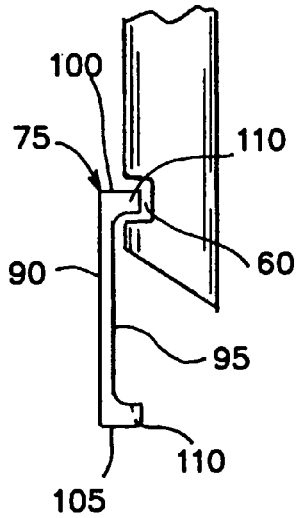
FIG. 16
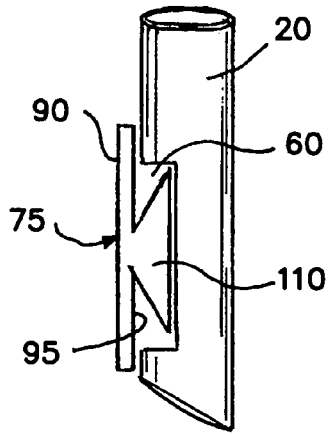
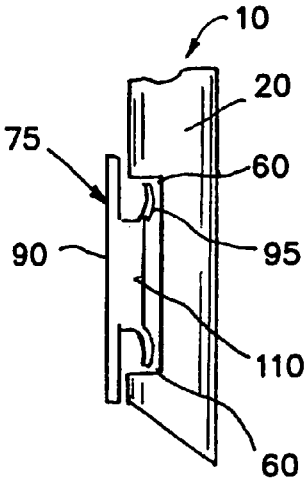
FIG. 17
FIG. 18
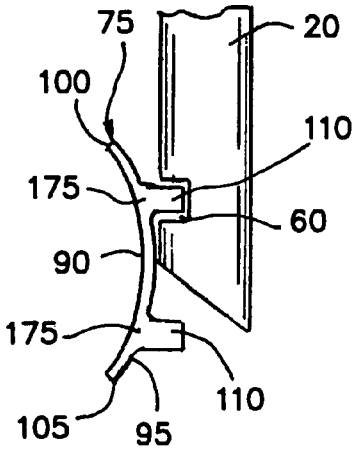
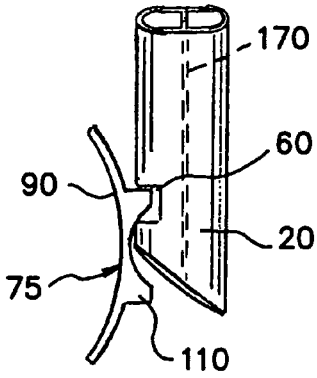
95
FIG. 19

RETAINING-LOCKING SYSTEM FOR CHAIN LINK FENCE SLATS

FIELD OF INVENTION

The invention pertains to privacy fences. More particularly, the invention relates to devices for retaining and locking privacy slats to chin link fences.

BACKGROUND OF THE INVENTION

Chain link fences have many advantages. They provide strong barrier to entry, can be erected easily and inexpensively, are well adapted to hilly terrain and may be used for residential or industrial purposes. One disadvantage that they have is that they do not provide much privacy as one can readily see through them. To deal with this shortcoming, a number of solutions have been developed. Most common is the interspersing of various types of slats into the diamonds or openings in the fencing. As the fences are subject to wind, weather, gravity and vandalism these slates tend to become loose and shift downwardly.

A number of solutions to this shifting problem have been developed. U.S. Pat. No. 4,570,906, issued to Walden, describes an assembly of slat members for insertion in a chain link fence includes a plurality of elongate, first slat members having opposed, substantially planar faces predimensioned to be interwoven between vertically consecutive links of the fence, each first slat member having one end formed with edges and a pair of resilient, spaced-apart flange members. The assembly also includes a second slat member having opposed, substantially planar faces predimensioned to be interwoven between horizontally consecutive, lower links of the fence for presenting an edge facing upwardly. The first slat members are downwardly positionable through the vertically consecutive links to a position whereby the bottom edge of each first slat member abuts or seats upon the upwardly facing edge of the second slat member, with the flange members overlapping opposite faces of the second slat member.

U.S. Pat. No. 4,723,761, issued to Cluff discloses a means for retaining slats woven flatwise through the links of a chain link fence. A receptacle is formed in each of the slats and a generally U-shaped clip member having legs engages respective receptacles in adjacent slats.

U.S. Pat. No. 4,836,505, issued to Meglino describes a slat retainer for chain link fences of the type having a plurality of parallel slats woven through the fence wires. A strip member extends across the slats and is connected to each of the slats. The strip member preferably extends across the top area of the slats. A cover is mounted over the top of the slats and the strip.

U.S. Pat. No. 4,860,997, issued to Schoenheit et al. describes a slat assembly for insertion in a chain link fence that includes a plurality of elongate, first slat members which are interwoven between vertically consecutive links of the fence. The first slat members rest on a second slat member that is interwoven between horizontally consecutive lower links in the fence. A flexible retainer is constructed and arranged to be received in apertures formed in the first slat members. The retainer has terminating means located at the ends thereof for securing the retainer to the slats.

U.S. Pat. No. 4,950,098, issued to Abbot et al. discloses a slat fence retainer for retaining slats in a chain-link fence that includes a horizontally disposed slat-retaining element having a pair of spaced apart side walls, a base joining the bottom margin of the side walls and an open top. The element includes a vertical-slat retention means. Plural, vertical slat elements are pre-dimensioned to be received in the links in the fence. Each vertical slat element has at least one substantially planar and resilient flange at its end and slots formed adjacent the end for engagement with the slat retention means to hold the vertical slat element in the fence.

U.S. Pat. No. 4,995,591 issued to Humphrey et al. describes a chain link fencing employing slats inserted vertically through adjacent links into an open channel that is inserted horizontally through the lowermost or uppermost course of links, a means of locking the slats to the channel to prevent easy removal of the slats from the fencing. Each slat is manufactured with a notch near one end thereof, and the channel is manufactured with a continuous barb along each free edge, one of which will engage the notch on the slat when the slat is inserted perpendicularly into the channel. For ease of assembly, the end of each slat nearest the notch is beveled.

U.S. Pat. No. 5,007,619, issued to Sibeni describes a chain link fence assembly that includes chain link wire fencing, a bottom horizontal channel, and a top horizontal channel. The assembly also includes a plurality of slats, which have lock tabs at their bottom ends. The bottom channel has a web, which has a plurality of spaced cutouts that receive the respective lock tabs. Each slat, which can be a vertical slat or a diagonal slat, has a central tubular portion, a left edge fin portion and a right edge fin portion. The lock tab, which is an extension of the slat tubular portion, has opposite edge recesses, which receive the opposite edges of its cutout, and has opposite projections, which hook behind the opposite edges of its cutout.

It is an objective of the present invention to provide a system for retaining privacy slats in the diamonds in chain link fences. It is a further objective to provide a retaining system that is readily usable with standard flat, tubular or single wall privacy slats. It is yet a further objective to provide a system that can be used with slats having either a vertical or horizontal orientation. It is a still further objective of the invention to provide a system that is not dependent upon the horizontal or vertical spacing of the slats. It is another objective of the invention to provide a system that cannot be easily disassembled for removal. Finally, it is an objective to provide a privacy slat retaining system that is inexpensive, durable and attractive in appearance.

While some of the objectives of the present invention are disclosed in the prior art, none of the inventions found include all of the requirements identified.

SUMMARY OF THE INVENTION (1) A retaining-locking system for chain link fence slats is provided. The system has a plurality of fence slat elements that are sized and shaped to be interwoven between consecutive links of a chain link fence. Each of the slat elements have a first end, a second end, a front surface, a back surface, a first side edge, a second side edge and a notch. The notch is orthogonally oriented to a long axis of the slat and is located between the first and second end and extends inwardly from the front surface toward the back surface for a first predetermined distance.

A retaining-locking strip is provided. The strip is formed of resilient material, having a first end, a second end, an inner surface, an outer surface, an upper edge, a lower edge and at least one securing protrusion. The securing protrusion has a base, a back surface, an upper surface, a lower surface and is sized and shaped to fit slidably within the notch. The protrusion is located upon the outer surface of the strip.

When the slat elements are interwoven into between consecutive links of a chain link fence with each of the notches aligned with one another, the retaining-locking strip inserted between the slat elements and the links, oriented orthogonally to the slats with the securing protrusion disposed within the slats, the strip will urge the slats toward the links, thereby retaining the slats within the chain link fence.

(2) In a variant of the invention, the notch in each of the slat elements is rectangular in cross-section.

(3) In another variant of the invention, the inner surface of the retaining-locking strip is concave and the outer surface of the retaining-locking strip is convex.

(4) In a further variant of the invention, the inner surface of the retaining-locking strip is substantially parallel to the outer surface of the retaining-locking strip when the strip is compressed between the securing protrusion and the inner surface.

(5) In still a further variant of the invention, the securing protrusion is relieved toward the outer surface of the retaining-locking strip, thereby conserving material.

(6) In another variant, a strengthening element is provided. The strengthening element is centrally disposed upon the inner surface of the retaining-locking strip and extends inwardly from the inner surface for a second predetermined distance and extends toward the upper and lower edges of the strip for a third predetermined distance. The strengthening element serves to make the strip more resilient.

(7) In a further variant, the base of the securing protrusion has a width greater than a width of the back surface of the protrusion.

(8) In still a further variant, either the first or second end of the slat element is pointed, thereby permitting the retaining-locking strip to be interwoven first between consecutive links of the chain link fence. Successive slat elements could then be interwoven orthogonally between consecutive links of the chain link fence, the pointed end permitting the slat element to compress the retaining-locking strip until the securing protrusion is aligned with the notch.

(9) In another variant, the base of the securing protrusion has a width less than a width of the back surface of the protrusion.

(10) In yet another variant, the inner surface of the retaining-locking strip is substantially flat and has upper and lower inward angled resilient retaining arms attached to the upper and lower edges of the strip, respectively.

(11) In a further variant, the slat elements are of tubular construction.

(12). In still a further variant, the slat elements include at least one internal reinforcing rib.

(13) In another variant, the inner surface of the retaining-locking strip is substantially flat and the outer surface of the strip is concave. The retaining-locking strip has at least one securing protrusion located adjacent at least one of either the upper edge or the lower edge of the strip.

(14) In yet another variant, the inner surface of the retaining-locking strip is concave and the outer surface of the retaining-locking strip is convex. The retaining-locking strip has at least one securing protrusion located at a point spaced from at least one of either the upper edge or the lower edge of the strip.

DESCRIPTION OF THE DRAWINGS

FIG. 14 is a side elevational cross-section view of an eleventh embodiment of a retaining-locking strip installed in a fence slat;

FIG. 15 is a side elevational cross-section view of a twelfth embodiment of a retaining-locking strip installed in a fence slat with a smaller notch;

FIG. 16 is a side elevational cross-section view of the fourth embodiment of the retaining-locking strip installed in a fence slat;

FIG. 17 is a side elevational cross-section view of a thirteenth embodiment of a retaining-locking strip installed in a fence slat;

FIG. 18 is a side elevational cross-section view of a fourteenth embodiment of a retaining-locking strip installed in a fence slat with a smaller notch; and FIG. 19 is a side elevational cross-section view of the first embodiment of the retaining-locking strip installed in a fence slat with a smaller notch.

Figure 1:
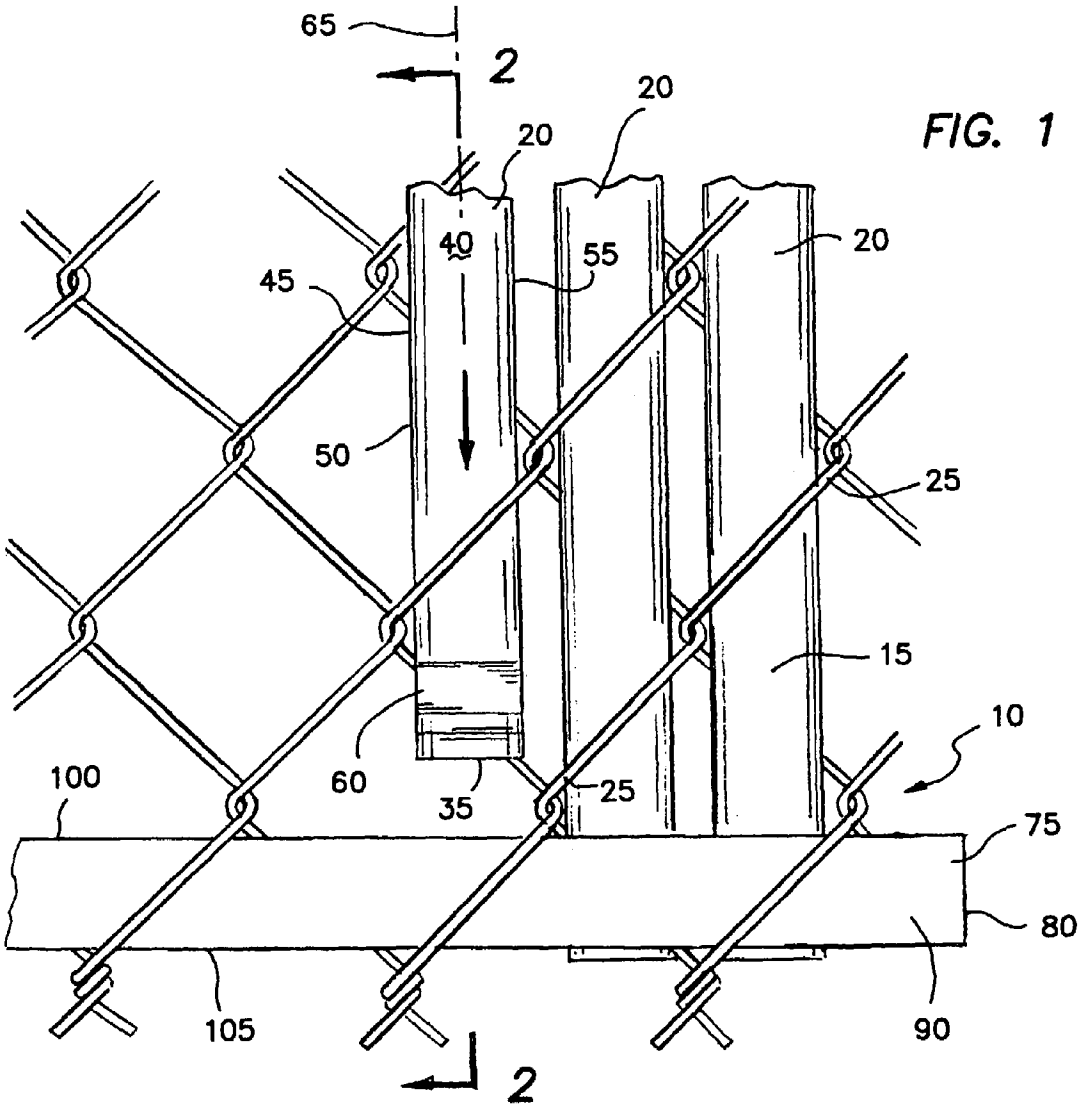
FIG. 1 is a front elevational view of the preferred embodiment of the invention illustrating insertion of a fence slat in a chain link fence with a notch at the bottom of the slat.

DETAILED DESCRIPTION OF THE PREFERRED EMBODIMENT (1) As illustrated in FIGS. 1, 2, 2A and 4, a retaining-locking system 10 for chain link fence slats 15 is provided. The system 10 has a plurality of fence slat elements 20 that are sized and shaped to be interwoven between consecutive links 25 of a chain link fence. Each of the slat elements 20 have a first end 30, a second end 35, a front surface 40, a back surface 45, a first side edge 50, a second side edge 55 and a notch 60. The notch 60 is orthogonally oriented to a long axis 65 of the slat 15 and is located between the first 30 and second 35 end and extends inwardly from the front surface 40 toward the back surface 45 for a first predetermined distance 70.

A retaining-locking strip is provided 75. The strip 75 is formed of resilient material, having a first end 80, a second end (not shown), an inner surface 90, an outer surface 95, an upper edge 100, a lower edge 105 and at least one securing protrusion 110. The securing protrusion 110 has a base 115, a back surface 120, an upper surface 125, a lower surface 130 and is sized and shaped to fit slidably within the notch 60. The protrusion 110 is located upon the outer surface 95 of the strip 75. When the slat elements 20 are interwoven into between consecutive links 25 of a chain link fence with each of the notches 60 aligned with one another, with the retaining-locking strip 75 inserted between the slat elements 20 and the links 25, oriented orthogonally to the slats 15 with the securing protrusion 110 disposed within the slats 15, the strip 75 will urge the slats 15 toward the links 25, thereby retaining the slats 15 within the chain link fence.

(2) In a variant of the invention, the notch 60 in each of the slat elements 20 is rectangular in cross-section.

(3). In another variant of the invention, the inner surface 90 of the retaining-locking strip 75 is concave and the outer surface 95 of the strip 75 is convex.

(4) In a further variant of the invention, as illustrated in FIGS. 16 and 17, the inner surface 90 of the retaining-locking strip 75 is substantially parallel to the outer surface 95 of the strip 75 when the strip 75 is compressed between the securing protrusion 110 and the inner surface 90.

(5) In still a further variant of the invention, as illustrated in FIGS. 2, 2A, 3, 4, 8, 9, 10, 12, 13, 14, 17, 18 and 19, the securing protrusion 110 is relieved toward the outer surface 95 of the retaining-locking strip 75, thereby conserving material.

Figure 5:
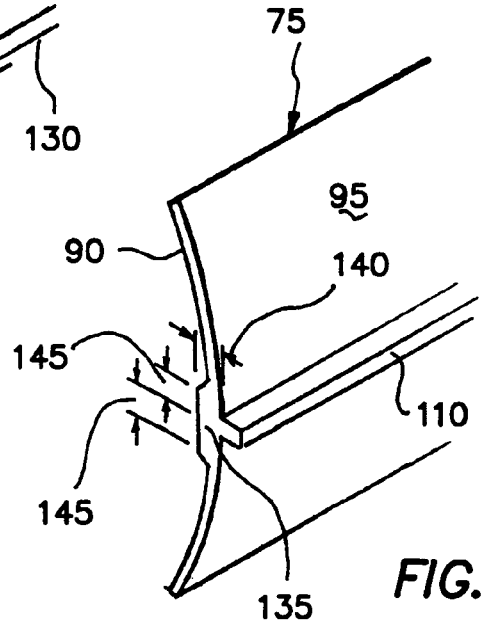
FIG. 5 is a perspective view of a second embodiment of a retaining-locking strip.

(6) In another variant, as illustrated in FIG. 5, a strengthening element 135 is provided. The strengthening element 135 is centrally disposed upon the inner surface 90 of the retaining-locking strip 75 and extends inwardly from the inner surface 90 for a second predetermined distance 140 and extends toward the upper 100 and lower edges 105 of the strip 75 for a third predetermined distance 145. The strengthening element 135 serves to make the strip 75 more resilient.

Figure 6:
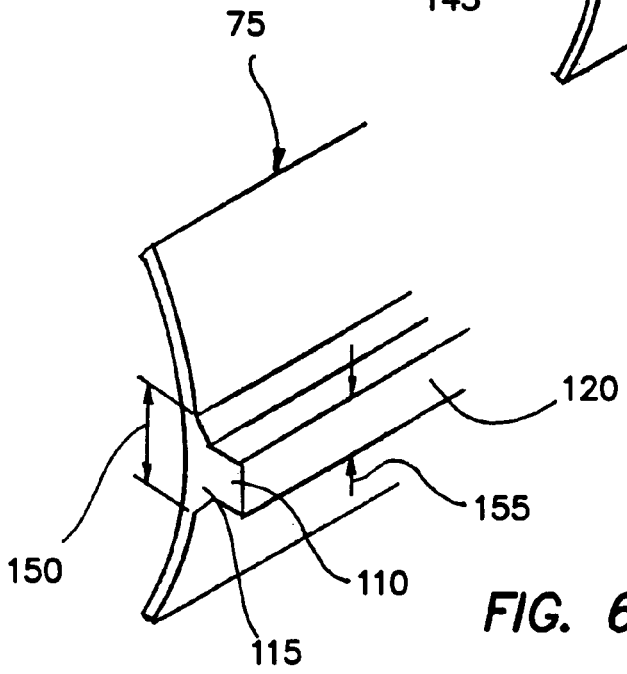
FIG. 6 is a perspective view of a third embodiment of a retaining-locking strip.

(7) In yet another variant, as illustrated in FIG. 6, the base 115 of the securing protrusion 110 has a width 150 greater than a width 155 of the back surface 120 of the protrusion 110.

Figure 2:
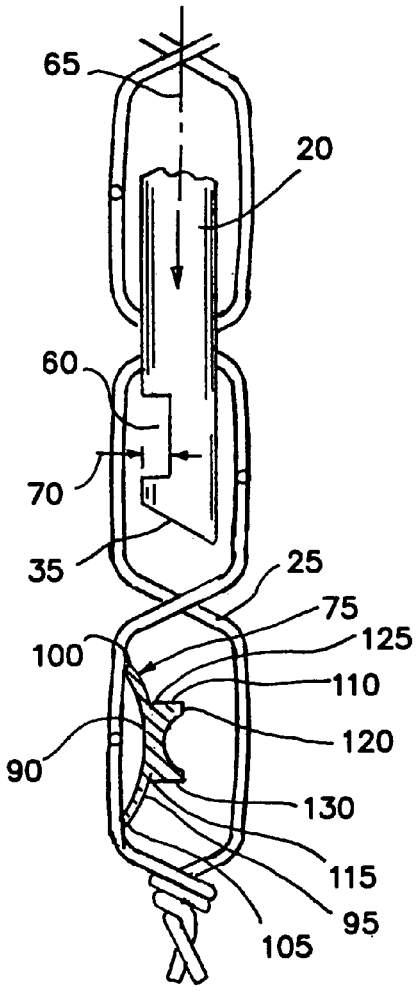
FIG. 2 is a side elevational cross-section of the FIG. 1 embodiment taken along the line 2—2.
Figure 2A:
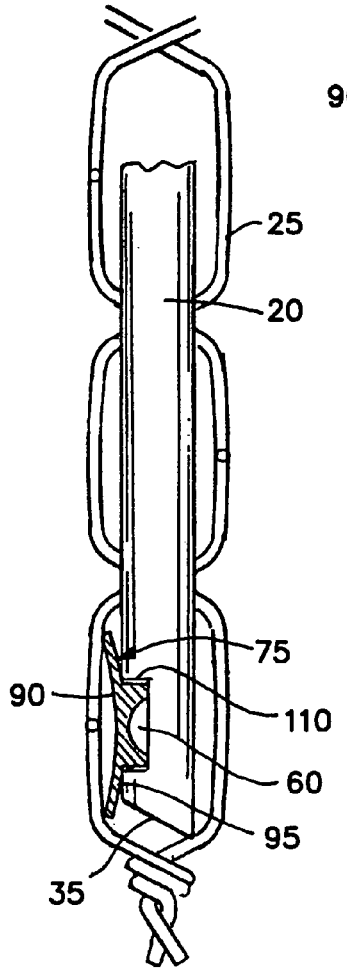
FIG. 2A is a side elevational cross-section of the FIG. 1 embodiment taken along the line 2—2 illustrating the fence slat locked in place.
Figure 3:
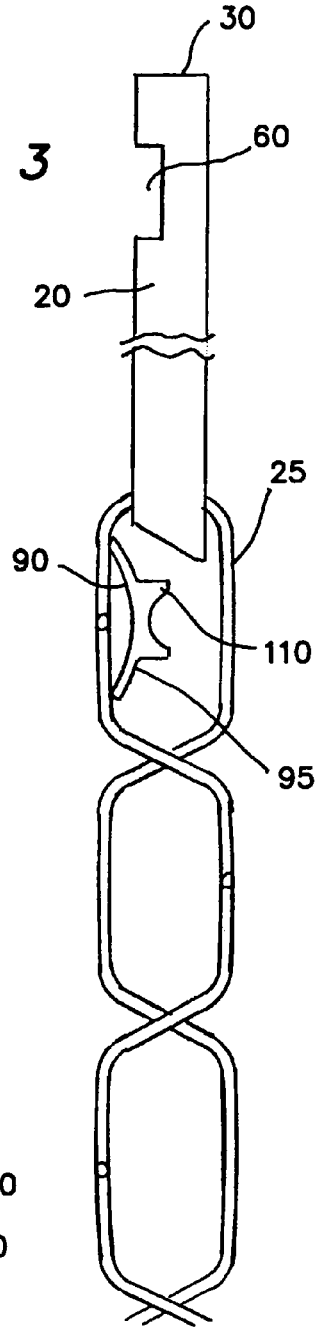
FIG. 3 is a side elevational cross-section of a second embodiment of the invention illustrating insertion of a fence slat in a chain link fence with a notch at the top of the slat.
Figure 4:
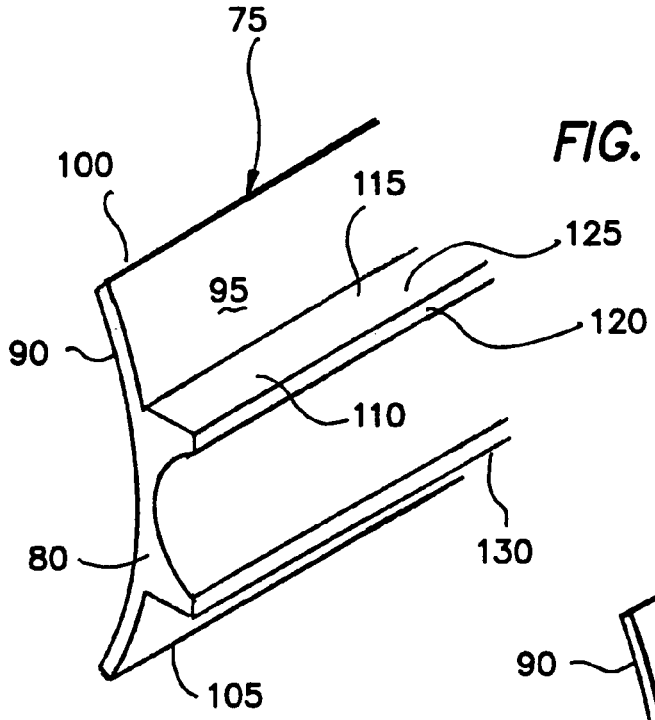
FIG. 4 is a perspective view of a first embodiment of a retaining-locking strip.

(8) In still a further variant, as illustrated in FIGS. 2, 2A, and 3, either the first 30 or second 35 end of the slat element 20 is pointed, thereby permitting the retaining-locking strip 75 to be interwoven first between consecutive links 25 of the chain link fence. Successive slat elements 20 could then be interwoven orthogonally between consecutive links 25 of the chain link fence, the pointed end permitting the slat element 20 to compress the retaining-locking strip 75 until the securing protrusion 110 is aligned with the notch 60.

Figure 7:
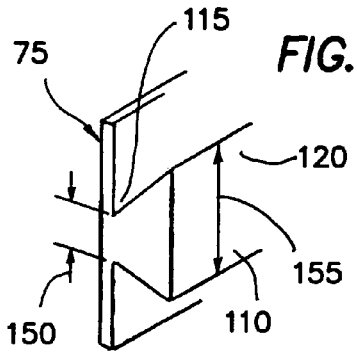
FIG. 7 is a perspective view of a fourth embodiment of a retaining-locking strip.

(9) In another variant, as illustrated in FIG. 7, the base 115 of the securing protrusion 110 has a width 150 less than a width 155 of the back surface 120 of the protrusion 110.

Figure 8:
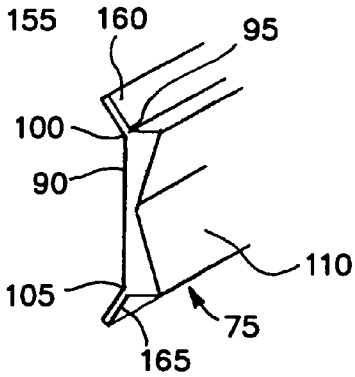
FIG. 8 is a perspective view of a fifth embodiment of a retaining-locking strip.
Figure 9:
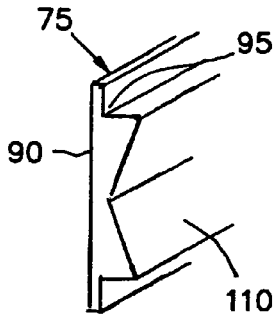
FIG. 9 is a perspective view of a sixth embodiment of a retaining-locking strip.
Figure 10:
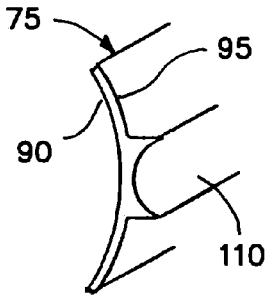
FIG. 10 is a perspective view of a seventh embodiment of a retaining-locking strip.
Figure 11:
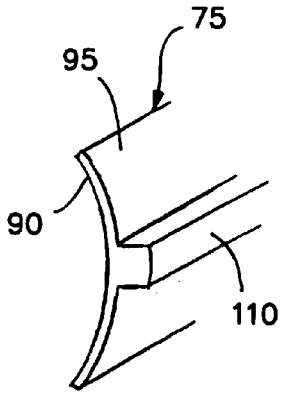
FIG. 11 is a perspective view of an eighth embodiment of a retaining-locking strip.
Figure 12:
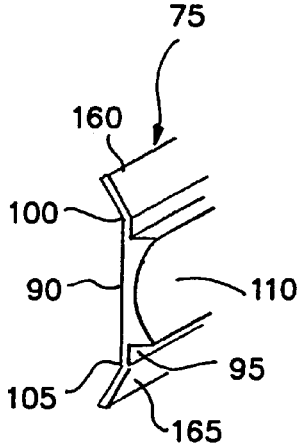
FIG. 12 is a perspective view of a ninth embodiment of a retaining-locking strip.
Figure 13:
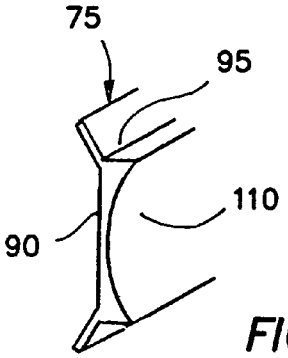
FIG. 13 is a perspective view of a tenth embodiment of a retaining-locking strip.

(10) In yet another variant 10, as illustrated in FIGS. 8 and 12, the inner surface 90 of the retaining-locking strip 75 is substantially flat and has upper 160 and lower 165 inward angled resilient retaining arms attached to the upper 100 and lower 105 edges of the strip 75, respectively.

(11) In a further variant, as illustrated in FIG. 16, the slat elements 20 are of tubular construction.

(12). In still a further variant, as illustrated in FIG. 19, the slat elements 20 include at least one internal reinforcing rib 170.

(13) In another variant, as illustrated in FIG. 5, the inner surface 90 of the retaining-locking strip 75 is substantially flat and the outer surface 95 of the strip 75 is concave. The retaining-locking strip 75 has at least one securing protrusion 110 located adjacent at least one of either the upper edge 100 or the lower edge 105 of the strip 75.

(14) In yet another variant, as illustrated in FIG. 18, the inner surface 90 of the retaining-locking strip 75 is concave and the outer surface 95 of the strip 75 is convex. The retaining-locking strip 75 has at least one securing protrusion 110 located at a point 175 spaced from at least one of either the upper edge 100 or the lower edge 105 of the strip 75.

The invention claimed is:

1. A retaining-locking system for chain link fence slats, comprising:

a plurality of fence slat elements, said slat elements being sized and shaped to be interwoven between consecutive links of a chain link fence;

each of said slat elements having a first end, a second end, a front surface, a back surface, a first side edge, a second side edge and a notch orthogonally oriented to a long axis of said slat, being disposed between said first end and said second end and extending inwardly from said front surface toward said back surface for a first predetermined distance;

a retaining-locking strip, said strip being formed of resilient material, having a first end, a second end, an inner surface, an outer surface, an upper edge, a lower edge and at least one securing protrusion;

said securing protrusion having a base, a back surface, an upper surface, a lower surface and being sized and shaped to fit slidably within said notch and being disposed upon said outer surface of said strip; and whereby, when said slat elements are interwoven into between consecutive links of a chain link fence with each of said notches aligned with one another, said retaining-locking strip inserted between said slat elements and said links, oriented orthogonally to said slats with said securing protrusion disposed within said slats, said strip will urge said slats toward said links, thereby retaining said slats within said chain link fence.

2. The retaining-locking system for chain link fence slats, as described in claim 1, wherein said notch in each of said slat elements is rectangular in cross-section.

3. The retaining-locking system for chain link fence slats, as described in claim 1, wherein said inner surface of said retaining-locking strip is concave and said outer surface of said retaining-locking strip is convex.

4. The retaining-locking system for chain link fence slats, as described in claim 1, wherein said inner surface of said retaining-locking strip is substantially parallel to said outer surface of said retaining-locking strip when said strip is compressed between said securing protrusion and said inner surface.

5. The retaining-locking system for chain link fence slats, as described in claim 1, wherein said securing protrusion is relieved toward said outer surface of said retaining-locking strip, thereby conserving material.

6. The retaining-locking system for chain link fence slats, as described in claim 1, further comprising a strengthening element, said strengthening element being centrally disposed upon said inner surface of said retaining-locking strip and extending inwardly from said inner surface for a second predetermined distance and extending toward said upper and lower edges of said strip for a third predetermined distance, said strengthening element serving to make said strip more resilient.

7. The retaining-locking system for chain link fence slats, as described in claim 1, wherein said base of said securing protrusion has a width greater than a width of said back surface of said protrusion.

8. The retaining-locking system for chain link fence slats, as described in claim 1, wherein either of said first end and said second end of said slat element is pointed, thereby permitting the retaining-locking strip to be interwoven first between consecutive links of said chain link fence and successive slat elements to then be interwoven orthogonally between consecutive links of said chain link fence, said pointed end permitting said slat element to compress said retaining-locking strip until said securing protrusion is aligned with said notch.

9. The retaining-locking system for chain link fence slats, as described in claim 1, wherein said base of said securing protrusion has a width less than a width of said back surface of said protrusion.

10. The retaining-locking system for chain link fence slats, as described in claim 1, wherein said inner surface of said retaining-locking strip is substantially flat and has upper and lower inward angled resilient retaining arms attached to upper and lower edges of said strip, respectively.

11. The retaining-locking system for chain link fence slats, as described in claim 1, wherein said slat elements are of tubular construction.

12. The retaining-locking system for chain link fence slats, as described in claim 11, wherein said slat elements include at least one internal reinforcing rib.

13. The retaining-locking system for chain link fence slats, as described in claim 1, wherein said inner surface of said retaining-locking strip is substantially flat and said outer surface of said retaining-locking strip is concave, said retaining-locking strip having at least one securing protrusion disposed adjacent at least one of said upper edge and said lower edge of said strip.

14. The retaining-locking system for chain link fence slats, as described in claim 1, wherein said inner surface of said retaining-locking strip is concave and said outer surface of said retaining-locking strip is convex, said retaining-locking strip having at least one securing protrusion disposed at a point spaced from at least one of said upper edge and said lower edge of said strip.

* * * * *